US008187426B2

(12) United States Patent
Spachman et al.

(10) Patent No.: US 8,187,426 B2
(45) Date of Patent: May 29, 2012

(54) STEAM SHOWER HAVING IMPROVED MAINTENANCE ACCESS

(75) Inventors: John Spachman, Cantonment, FL (US); Shizhong S. Duan, Vancouver (CA); David Doerschuk, Columbus, OH (US); Paul Durcan, Monaghan (IE)

(73) Assignee: ABB Ltd., Dublin (IE)

( * ) Notice: Subject to any disclaimer, the term of this patent is extended or adjusted under 35 U.S.C. 154(b) by 388 days.

(21) Appl. No.: 12/469,922

(22) Filed: May 21, 2009

(65) Prior Publication Data

US 2009/0294085 A1 Dec. 3, 2009

Related U.S. Application Data

(60) Provisional application No. 61/057,840, filed on May 31, 2008.

(51) Int. Cl.
*D21F 5/00* (2006.01)
*F26B 21/14* (2006.01)

(52) U.S. Cl. .... 162/275; 162/290; 162/375; 162/DIG. 6

(58) Field of Classification Search ..... 162/199, 162/207, 252, 289, 272, 275, 280, DIG. 6, 162/290, 375; 34/114, 444–446, 568, 629, 34/636, 638, 639
See application file for complete search history.

(56) References Cited

FOREIGN PATENT DOCUMENTS

WO WO 99/41450 * 8/1999
* cited by examiner

*Primary Examiner* — Eric Hug
(74) *Attorney, Agent, or Firm* — Paul R. Katterle

(57) ABSTRACT

A steam shower is provided for supplying steam to a web in a paper machine. The steam shower includes a diffuser assembly mounted to the cross-beam for movement in the direction of the longitudinal axis of the cross beam. The cross-beam defines an interior steam header for connection to a source of steam. The diffuser assembly includes a plurality of separated steam compartments. The diffuser assembly may be part of a steam provision assembly that is also mounted to the cross-beam for movement in the direction of the longitudinal axis of the cross beam. In addition to the diffuser assembly, the steam provision assembly includes a second steam header and steam valve modules.

27 Claims, 11 Drawing Sheets

STEAM SHOWER HAVING IMPROVED MAINTENANCE ACCESS

CROSS-REFERENCE TO RELATED APPLICATION

This application claims the benefit of U.S. provisional patent application No. 61/057,840 filed on May 31, 2008, which is hereby incorporated by reference in its entirety.

BACKGROUND OF THE INVENTION

This invention relates to steam showers and more particularly to a steam shower having an improved construction that facilitates maintenance.

Steam showers are widely used on paper machines to improve the operation of the machines as well as to improve the moisture profile of the paper products produced thereby. When steam contacts the cold surface of a moving paper web, it condenses into water. During the condensation, latent heat is released from the steam and absorbed by the moving web. With the absorption of the latent heat, the temperature of the moving web increases and therefore the tension inside the moving web decreases. Reduction of the tension inside the web allows the paper machine to run at a higher speed without breaking the web. Higher machine speed directly results in increased production. Another effect of higher web temperature is a reduction in the viscosity of water trapped among the fibers of the web. It is easier for the pressing nips located at the press section of the paper machine to remove moisture with lower viscosity from the web. In other words, it is easier for the pressing nips to remove hotter water from the web. Therefore, steam showers are normally installed right in front of the pressing nips for moisture profiling purpose.

A profiling steam shower generally includes a cross-beam structure, an array of steam valves and corresponding steam diffusers. The purposes of the cross-beam structure of the steam shower are twofold: it supports the structure of the steam shower across the whole width of paper machine and it also distributes process steam along the cross-machine (CD) direction inside the cross-beam. The steam valves located at each and every segment (or zone) of the cross-beam receive the process steam from the cross-beam structure and deliver the correct amount of process steam to each corresponding steam diffuser according to control signals sent from a control system. The steam diffuser further distributes the process steam to the surface of the moving web uniformly across the whole CD length of the steam diffuser.

A traditional steam shower has a highly integrated construction that requires the steam shower to be completely removed from the paper machine in order to perform service on steam actuator valve modules or steam diffusers. Some steam showers, however, do have a construction that permits the steam diffusers to be accessed for cleaning without the removal of the entire steam shower. One such steam shower is shown in U.S. Pat. No. 6,408,534 to Alen et al. The steam shower or steam box disclosed in the Alen et al. '534 patent includes a plurality of steam diffusers or regulator chambers covered by one or more hinged perforated screens, which may be pivoted upward to provide access to the regulator chambers. Since space must be provided to permit the perforated screens to be pivoted outward and upward, the steam shower of the Alen et al. '534 patent may not desirable for some applications.

Another steam shower that provides access to steam diffusers is shown in U.S. Patent Application Publication No. 2006/0107704 to Passiniemi. The steam shower in the Passiniemi publication has a plurality of steam diffusers or steam discharge chambers covered by a fixed screen plate. At the bottom of the screen plate, there are a plurality of narrow access slots that provide access to the steam discharge chambers, respectively. The access slots are covered by a removable cleanout bar. Since the access slots are narrow and located at the bottom of the screen, the steam shower of the Passiniemi publication appears to provide only limited access to the steam diffusers.

A steam shower that provides access to both steam diffusers and steam valve modules is shown in European patent application EP1310591A2 to Wegehaupt. The steam shower in EP1310591A2 has an interior box telescopically mounted inside an exterior box. The interior box includes all of the working components of the steam shower, including a main steam header, steam diffusers and steam valve modules. The interior box may be slid longitudinally outward to provide access to the steam diffusers and the steam valves. While the steam shower of EP1310591A2 provides access to both the steam diffusers and the steam valve modules, the steam shower requires the main steam header to be moved along with the steam diffusers and the steam valve modules, which unnecessarily increases the weight of the components that have be moved to provide the access.

Based on the foregoing, there is a need in the art for a steam shower that provides improved access to its steam diffusers and/or its steam valve modules. The present invention is directed to such a steam shower.

SUMMARY OF THE INVENTION

In accordance with the present invention, a steam shower is provided for supplying steam to a web in a paper machine. The steam shower includes a cross-beam having a longitudinal axis for disposal in the cross machine direction of the paper machine. The cross-beam has opposing ends and defines an interior steam header for connection to a source of steam. The steam shower also includes a diffuser assembly having a plurality of separated steam compartments. Each steam compartment has an inlet orifice and a plurality of outlet openings. The diffuser assembly is mounted to the cross-beam for movement in the direction of the longitudinal axis of the cross beam between a retracted position and an extended position. When the diffuser assembly is in the retracted position, the inlet orifices of the steam compartments are connected to the steam header for steam flow from the steam header to the inlet orifices. When the diffuser assembly is in the extended position, the steam compartments are disposed outward from one of the ends of the cross-beam and the inlet orifices of the steam compartments are disconnected from the steam header.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
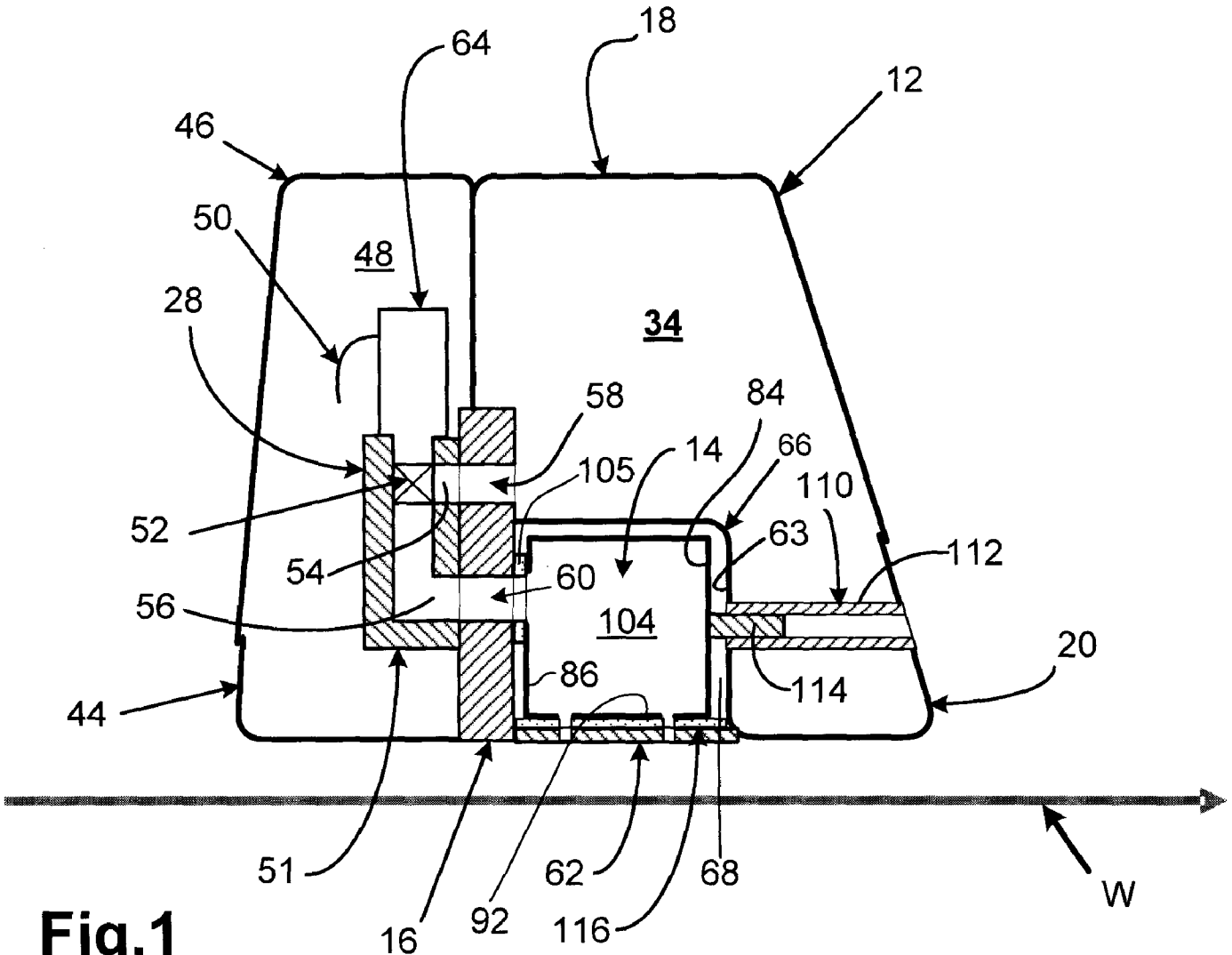
FIG. 1 shows a side sectional view of a first steam shower having a diffuser assembly movably mounted to a cross-beam.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 2:
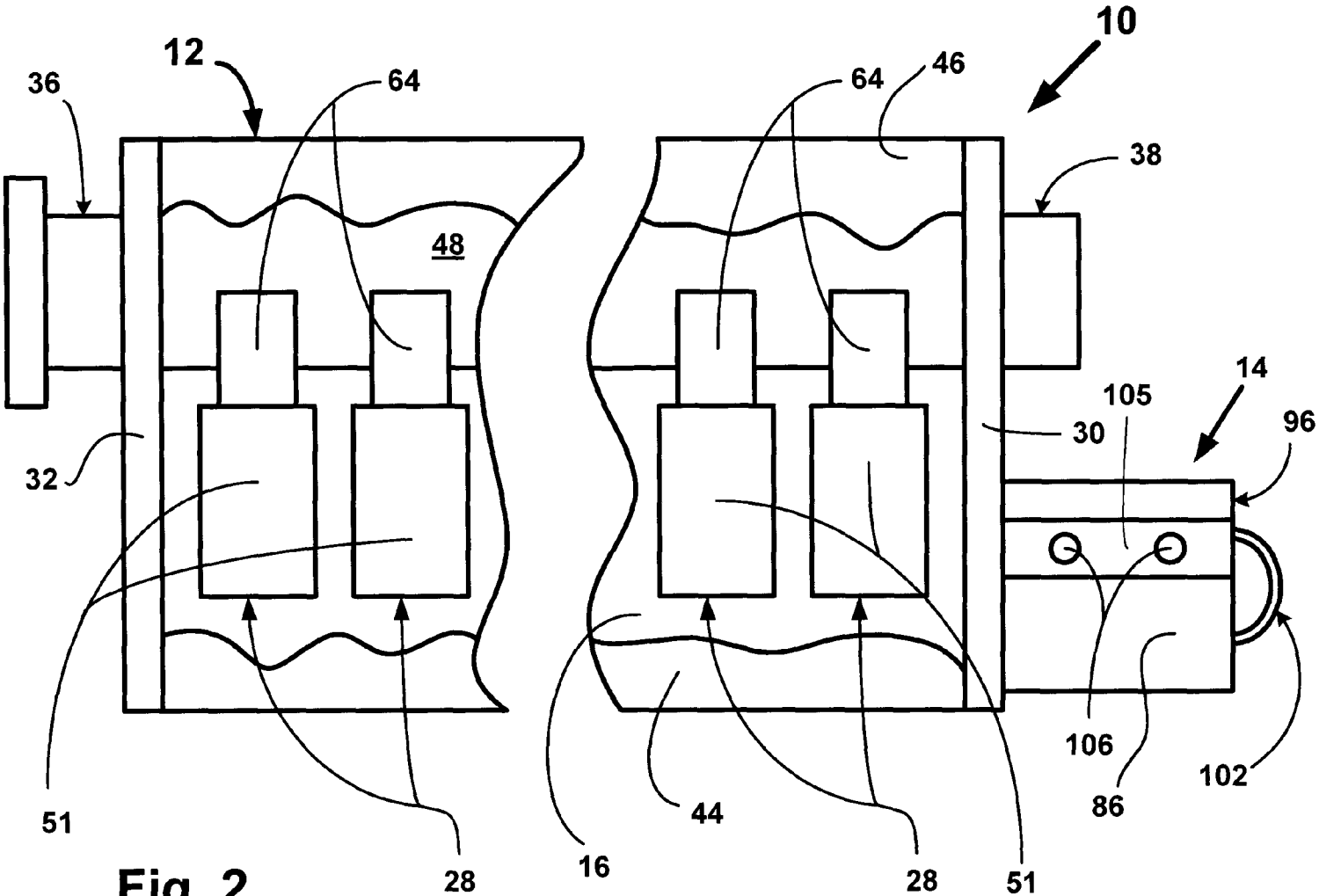
FIG. 2 shows a broken front view of the first steam shower with the diffuser assembly partially moved outward from the cross-beam and with a portion of a cover and a base structure broken away to show a valve chamber inside the cross-beam.

Referring now to FIGS. 1 and 2, a first steam shower 10 embodied in accordance with the present invention is shown. The first steam shower 10 is for use in a paper machine (not shown) and generally includes a diffuser assembly 14 movably mounted to a cross-beam 12. The cross-beam 12 has a driving end, a tending end and a longitudinal axis that extends in the cross machine direction of the paper machine.

As used in describing the steam shower 10 (and other steam showers), the terms "front" and "rear" are with reference to the direction of travel of paper moving through the paper machine, with the paper moving from the front to the rear of the steam shower 10.

The cross-beam 12 includes a mounting plate 16, an upper shroud 18 and a first base structure 20, all of which are composed of a metal, such as steel. The first base structure 20 is secured to the mounting plate 16 and to the upper shroud 18, such as by welding. The upper shroud 18 is secured to the mounting plate 16, such as by welding. End plates 30, 32 composed of metal are respectively secured (such as by welding) to opposing ends of each of the mounting plate 16, the upper shroud 18 and the first base structure 20 so as to form an enclosed steam chamber or header 34. At the driving end of the cross-beam 12, one end of a steam inlet pipe 36 is secured to the end plate 32 around an opening in the end plate 32. Another end of the steam inlet pipe 36 is connected to a process steam source (not shown). Steam from the process steam source is provided to the steam header 34 through the steam inlet pipe 36 and the opening in the end plate 32. At the tending end of the cross-beam 12, another pipe 38 with a closed end is secured to the end plate 30. The pipes 36, 38 may be connected to brackets (not shown), which support the first steam shower 10 against the frames of the paper machine. Pneumatic cylinders may be used with the bracket to move the first steam shower 10.

The cross-beam 12 further includes a second base structure 44 and a cover 46, which are also composed of a metal, such as steel. The second base structure 44 is secured to the mounting plate 16 and to the end plates 30, 32, respectively, such as by welding. The second base structure 44, the cover 46 and the end plates 30, 32 cooperate to define a valve chamber 48 for housing an array of steam actuator valve modules 28 and communication lines 50, which may be air tubes if the valve modules 28 utilize pneumatic actuators or electrical wires if the valve modules 28 utilize electrical actuators. The cover 46 is movably or removably mounted to the upper shroud 18 to provide access to the valve modules 28 and the communication lines 50.

Each valve module 28 includes a valve body 51, a valve 52 and an actuator 64 which may be electric or pneumatic. The valve body 51 has an inlet 54 and an outlet 56, with the valve 52 disposed in between. The actuator 64 is connected to the valve 52 and is operable to move the valve 52 between open and closed positions. A communication line 50 connects each actuator 64 to a control system (not shown). Each valve module 28 is mounted to the mounting plate 16 (such as by bolts) so that the inlet 54 and the outlet 56 are aligned with orifices 58, 60 in the mounting plate 16, respectively. A pair of the orifices 58, 60 is formed in the mounting plate 16 for each of the valve modules 28. The orifices 58 are in communication with the steam header 34, while the orifices 60 are in communication with zones 104, respectively, of the diffuser assembly 14.

Figure 3:
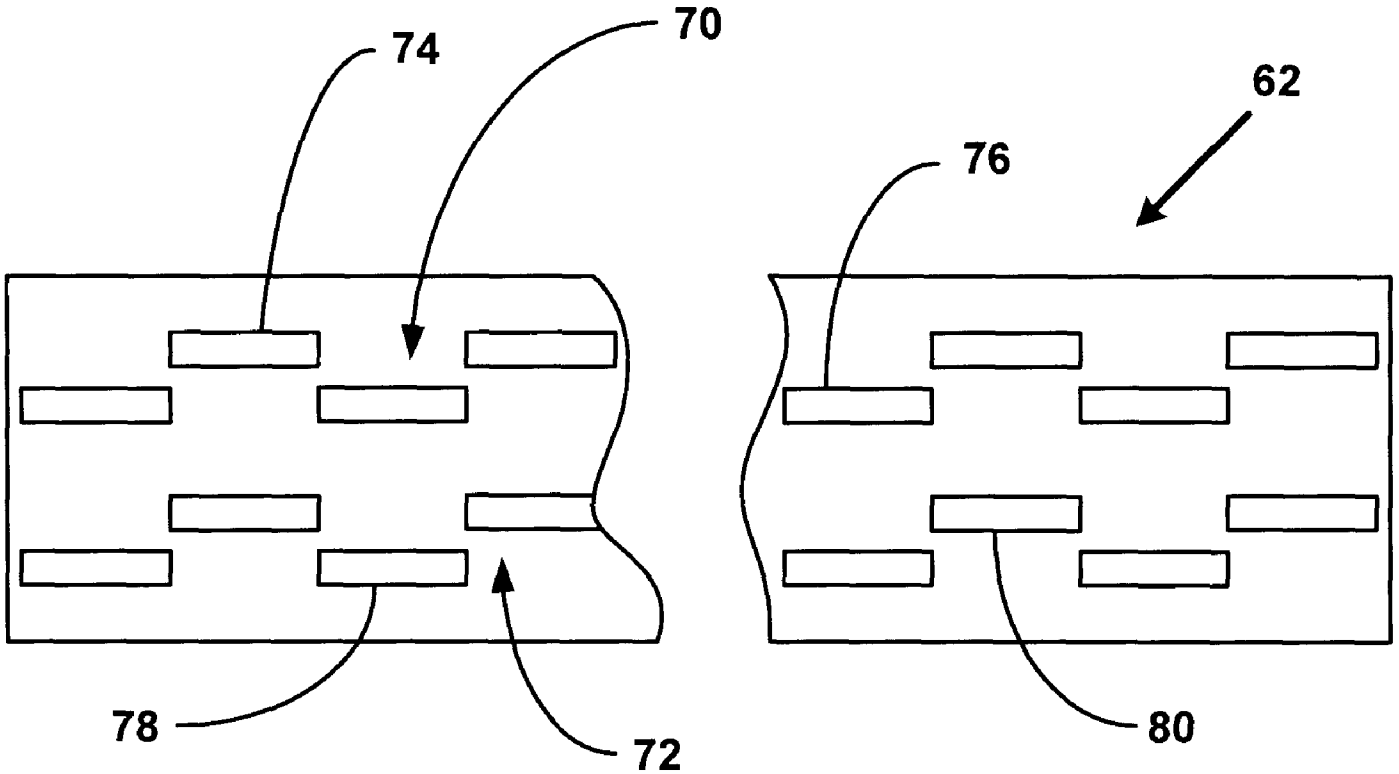
FIG. 3 shows a broken top plan view of a face plate of the cross-beam.

Referring now also to FIG. 3, a face plate 62 is secured between the mounting plate 16 and a vertical interior wall 63 of the first base structure 20, such as by spot welding. The interior wall 63 helps define a recessed portion 66 of the first base structure 20. The face plate 62 cooperates with the mounting plate 16 and the recessed portion 66 of the first base structure 20 to define a cuboidal passage 68 within the cross-beam 12 that extends substantially the entire length of the cross-beam 12. The face plate 62 holds the bottom portion of the first base structure 20 against the mounting plate 16 so that the cuboidal passage 68 does not deform and expand when steam header 34 is pressurized or when locking pistons 114 engage the diffuser assembly 14, as will be discussed more fully below. The face plate 62 has a slot group 70 and a slot group 72. Slot group 70 includes an array of slots 74 and an array of slots 76, each array extending in the CD direction. Slot group 72 includes an array of slots 78 and an array of slots 80, each array extending in the CD direction. Slots 74 are offset from slots 76 so that steam jets passing through the combination of slots 74 and 76 can reach any portion of the moving web W (see across the width of the web in the CD direction. Slots 78 and slots 80 are also offset for the same reason. Although two slot groups are shown in FIG. 3, it should be appreciated any number of slot groups could be used as long as the process steam can be delivered to any part of the moving web across the whole CD direction.

The end plate 30 has an enlarged opening that corresponds to, and is aligned with, the recessed portion 66 of the first base structure 20. This enlarged opening provides the passage 68 with an open end that extends through the end plate 30. The end plate 32 may, similarly, have an enlarged opening that corresponds to, and is aligned with, the recessed portion 66 in order to provide the passage 68 with a second, opposing open end that extends through the end plate 32. Alternately, the end plate 32 may cover the entire open end of the structure formed by the mounting plate 16, the upper shroud 18, the first base structure 20, the second base structure 44 and the cover 46, including the end of the recessed portion 66. With the end plate 32 so constructed, the passage 68 will have a closed end formed by the end plate 32 and an open end extending through the end plate 30.

The diffuser assembly 14 is telescopically mounted to the cross-beam 12 so as to be movable within the passage 68 between a retracted position, wherein the entire diffuser assembly 14 is fully disposed inside the passage 68 within the cross-beam 12, and an extended position, wherein all or most of the diffuser assembly 14 is disposed outside the passage 68 and the cross-beam 12. Of course, the entire diffuser assembly 14 may be completely removed from the cross-beam 12 through the enlarged opening in the end plate 30 and moved away from the paper machine. If the passage 68 has two open ends, the diffuser assembly 14 may extend longitudinally outward from either the tending end or the driving end of the cross-beam 12 when the diffuser assembly 14 is in the extended position, depending on which direction the diffuser assembly 14 is moved. If the passage 68 has only one open end (through the end plate 30), the diffuser assembly 14 extends longitudinally outward from the tending end of the cross-beam 12 when the diffuser assembly 14 is in the extended position. The passage 68 is sized to permit the diffuser assembly 14 to facilely slide within the passage 68. More specifically, the passage 68 is sized such that when the diffuser assembly 14 is in the retracted position, a front gap is formed between the mounting plate 16 and a front wall 86 of the diffuser assembly 14, and a rear gap is formed between a vertical interior wall 63 of the first base structure 20 and a rear wall 84 of the diffuser assembly 14. A top gap is also formed between a horizontal wall of the first base structure 20 and a top wall of the diffuser assembly 14.

Figure 4:
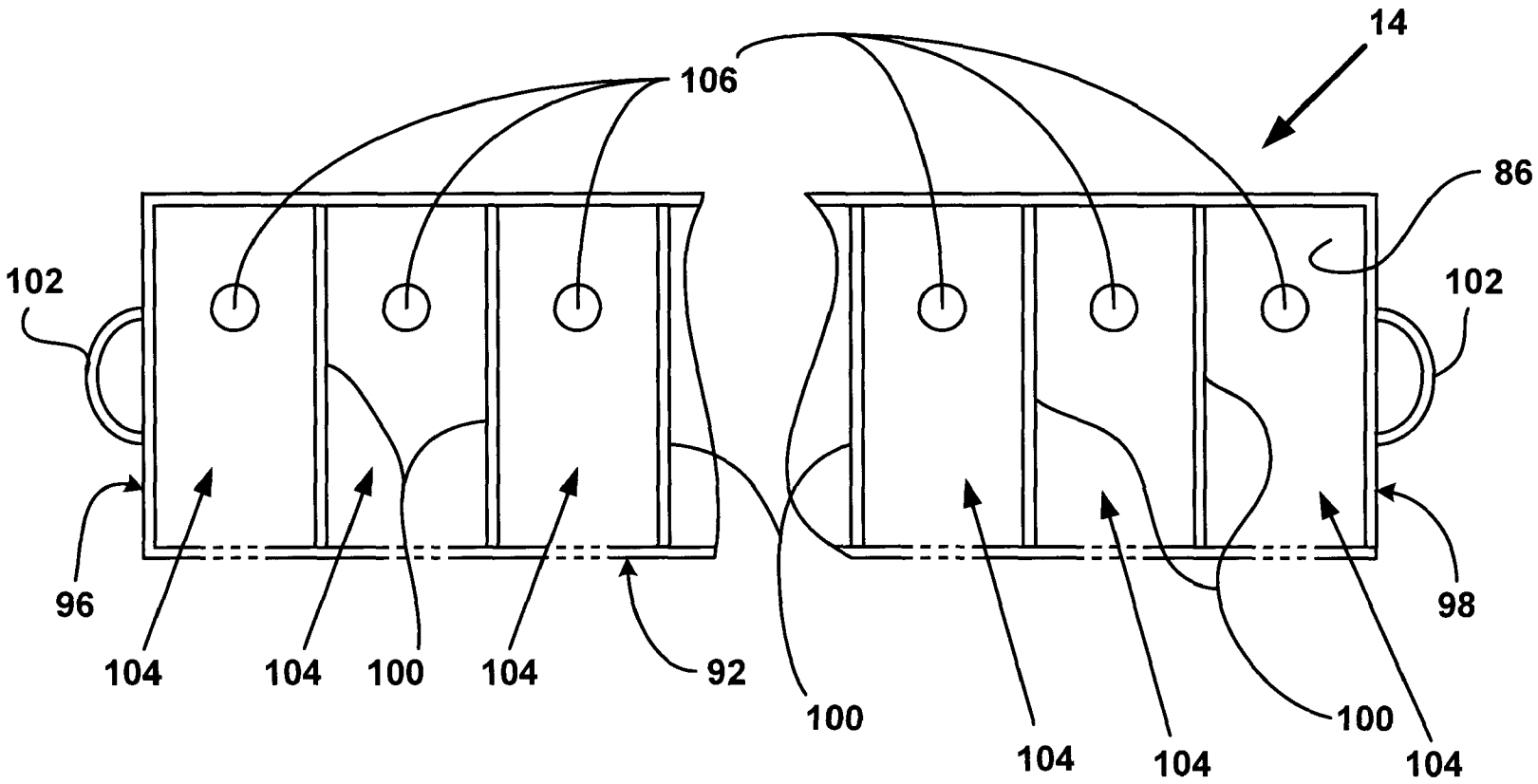
FIG. 4 shows a broken rear view of the diffuser assembly with a rear wall removed.

Referring now to FIG. 4, the diffuser assembly 14 is shown with the rear wall 84 removed. The diffuser assembly 14 is parallelepiped, more particularly cuboidal, in shape and comprises the top wall, a bottom wall 92, opposing end plates 96, 98, the front wall 86, the rear wall 84 and a plurality of baffle plates 100, all of which are composed of metal, such as steel. A handle 102 is secured to the end plate 96 on the tending end. As shown, another handle 102 may be secured to the end plate 98 on the driving end. Maintenance personnel may grasp the handle(s) 102 to push and/or pull the diffuser assembly 14 between the extended and retracted positions.

The baffle plates 100 are evenly spaced apart and divide the interior of the diffuser assembly 14 into a series of compartments or zones 104. A series of inlet openings 106 are formed in the front wall 86 such that each zone 104 has an inlet opening 106. When the diffuser assembly 14 is in the retracted position within the cross-beam 12, the inlet opening 106 in each zone 104 is aligned with the orifice 60 in the mounting plate 16 for the valve module 28 corresponding to the zone 104. When the diffuser assembly 14 is in the extended position, all of the zones 104 are disposed outside of the cross-beam 12. A gasket 105 with openings is secured to an outer surface of the front wall 86 such that the openings are aligned over the inlet openings 106. The gasket 105 may be secured to the front wall 86 by adhesive and/or by mechanical means. The gasket 105 is composed of a compressible material, such as rubber, silicone, or a polymer such as polytetrafluoroethylene or polychlorotrifluoroethylene. In lieu of using a single gasket 105, a plurality of gaskets may be used, one for each of the inlet openings 106. In addition, in lieu of securing the gasket 105 to the front wall 86, the gasket 105 may instead be secured to the mounting plate 16.

Figure 5:
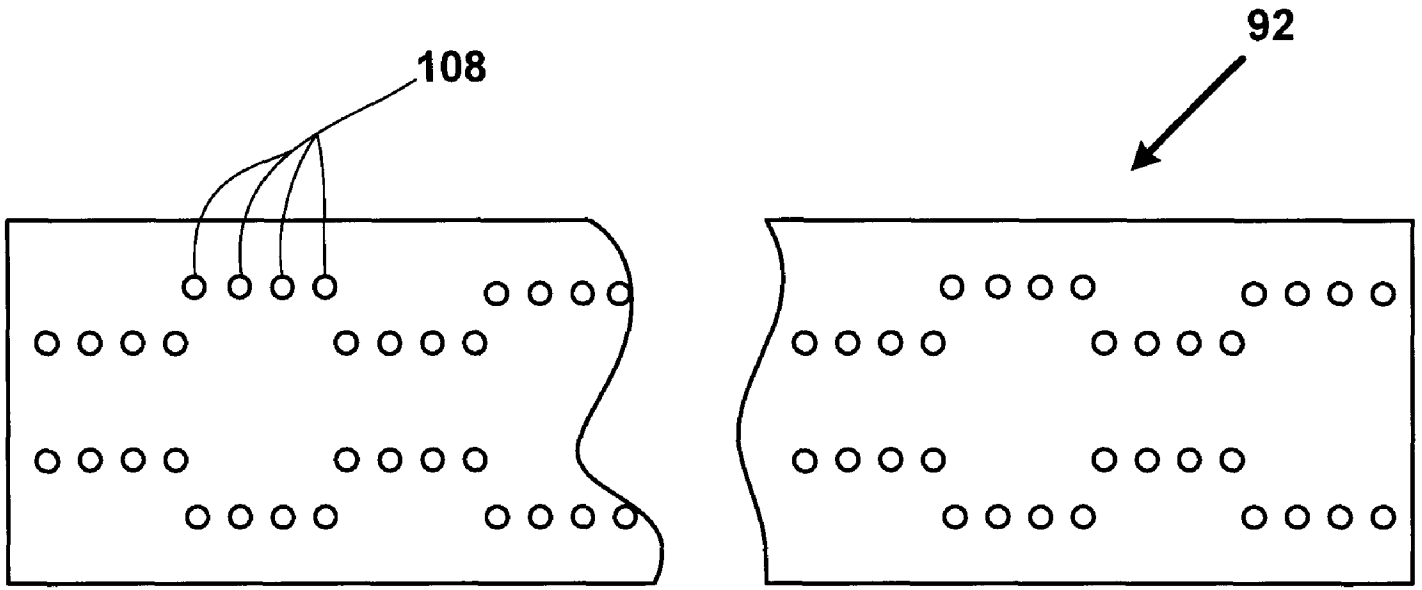
FIG. 5 shows a broken top plan view of a first embodiment of a bottom wall of the diffuser assembly.

Referring now to FIG. 5, the bottom wall 92 of the diffuser assembly 14 is shown. Bottom wall 92 includes a plurality of small orifices 108 which have a pattern that matches with the slot patterns in the face plate 62 (see FIG. 3). The orifices 108 are uniformly distributed along the CD direction to ensure that process steam is delivered to the moving web uniformly across the CD direction when all of the valve modules 28 have identical setpoints or the valve modules 28 are set at the same opening position.

Referring back to FIG. 1, locking devices 110 are provided to secure the diffuser assembly 14 in the retracted position and to form sealed connections between the inlet openings 106 and the orifices 60. Each locking device 110 includes a pipe 112 with an internal locking piston 114. Each pipe 112 is secured to, and extends through, the first base structure 20, with an outer end of the pipe 112 being secured in an opening in a sloping exterior wall of the first base structure 20 and an inner end of the pipe 112 being secured in an opening in the vertical interior wall 63 of the base structure 20. The pistons 114 are axially movable within the pipes 112, respectively, to move forward and rearward into and out of contact, respectively, with the rear wall 84 of the diffuser assembly 14. When the locking devices 110 are activated, the pistons 114 contact the rear wall 84 of the diffuser assembly 14 and move the diffuser assembly 14 forward into engagement with the mounting plate 16. The pistons 114 press the gasket 105 of the diffuser assembly 14 against the mounting plate 16, thereby securing the diffuser assembly 14 from movement and forming seals between the orifices 60 and the inlet openings 106 to prevent steam leakage.

The number of locking devices 110 can be less than the total number of the valve modules 28. The spacing between neighboring locking devices 110 is selected to provide good sealing between the diffuser assembly 14 and the mounting plate 16, i.e., to prevent substantial leakage of steam when steam flows from the orifices 60 to the inlet openings 106. Such spacing may be from about 12 inches to about 18 inches.

Depending on the accessibility of the rear of the first steam shower 10, the locking devices 110 may be locally activated or remotely activated. If the locking devices 110 are locally activated, the interior surfaces of the pipes 112 may be threaded and the locking pistons 114 may be set screws that are threadably movable by a person using a hex key or similar driving device. If the locking devices are remotely activated, the locking piston 114 may be part of a pneumatic or electrical linear actuator that is controlled by signals received from the control system.

In order to facilitate the movement of the diffuser assembly 14 within the passage 68, the diffuser assembly 14 may be provided with pads 116 composed of a low friction material, such as polytetrafluoroethylene (PTFE), fluorinated ethylene propylene (FEP), a perfluoroalkoxy (PFA) polymer, or brass. The pads 116 may be secured to those surfaces of the diffuser assembly 14 that experience significant friction during movement. For example, the pads 116 may be secured to the bottom surface of the bottom wall 92 of the diffuser assembly 14. Instead of using the pads 116, the bottom surface of the bottom wall 92 and other friction-experiencing surfaces may be coated with a layer of a low friction material, such as PTFE, etc. In lieu of the pads 116 or coatings, the diffuser assembly 14 may be provided with wheels (not shown) that are supported on non-perforated portions of the face plate 62 located toward the longitudinal edges thereof, or on tracks mounted to the mounting plate 16 and the interior wall 63, respectively.

The operation of the first steam shower 10 will now be described with reference to FIGS. 1 and 2. Pressurized process steam enters the steam inlet pipe 36 and flows into the steam header 34. For each valve module 28 having an open valve 52, steam flows into the orifice 58 in the mounting plate 16, passes by the opened valve 52, passes through the orifice 60 in the mounting plate 16 and enters the zone 104 corresponding to the valve module 28. After entering the zone 104, the steam travels to the bottom wall 92, passes through the orifices 108 (shown in FIG. 5) in the bottom wall 92 and then exits the first steam shower 10 through the slots 74-80 (shown in FIG. 3) in the face plate 62. After exiting the first steam shower 10, the steam impinges on the surface of the moving web W.

In order to obtain a more uniform moisture profile across the web W in the CD direction, the valve modules 28 may be independently controlled by the control system to provide different amounts of steam from the different zones 104.

After the first steam shower 10 has been in service for a period of time, the operation of the diffuser assembly 14 may become adversely affected by the build-up of contaminants, such as fibers, that have been flung out from the moving web W. The contaminants may block the relatively small orifices 108 in the bottom wall 92, thereby preventing steam from properly exiting the zones 104. At this point, the diffuser assembly 14 should be cleaned when the paper machine is next shut down. In order to clean the diffuser assembly 14, the locking devices 110 are first released (deactivated). The diffuser assembly 14 is then manually moved by one or more persons to the extended position, such as by pushing and/or pulling the handle 102. While the diffuser assembly 14 is in the extended position, the diffuser assembly 14 and, more specifically, the zones 104 and the bottom wall 92 may be cleaned using high pressure jets of water, alone or in combination with mechanical means such as brushes. Alternately, the diffuser assembly 14 may be completely removed from the cross-beam 12 and moved to another location where the cleaning is performed. When the cleaning is complete, the diffuser assembly 14 is slid back into the cross-beam 12 to the retracted position and the locking devices 110 are activated. As can be appreciated, the cleaning of the first steam shower 10 is much simpler than in prior art steam showers since the entire first steam shower 10 does not need to be removed from the paper machine.

Figure 6:
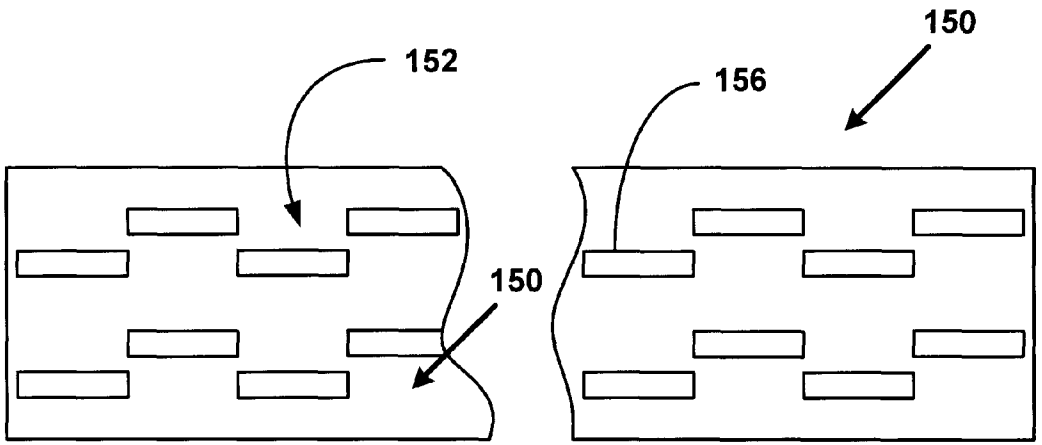
FIG. 6 shows a broken top plan view of a second embodiment of the bottom wall of the diffuser assembly.
Figure 7:
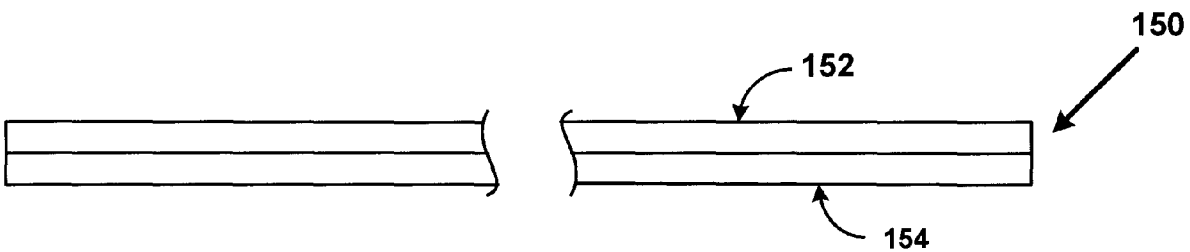
FIG. 7 shows a broken side view of the second embodiment of the bottom wall of the diffuser assembly.

It should be appreciated that various modifications may be made to the first steam shower 10 without departing from the scope of the invention embodied therein. One such modification will now be described with reference to FIGS. 6 and 7. In lieu of the diffuser assembly 14 having the bottom wall 92, the diffuser assembly 14 may have a steam distribution plate 150. The steam distribution plate 150 includes an upper plate 152 secured to a lower plate 154. The upper plate 152 is formed from sheet metal and has arrays of slots 156 arranged in a pattern substantially similar to the pattern of slots in the face plate 62. The lower plate 154 is composed of porous metal. The porous metal is formed from metal powder of a relatively uniform particle size that is compacted under pressure, such as in a die, and is then heated, or sintered, under a controlled atmosphere at a temperature that is below the melting point of the metal, but is still sufficient to bond the powder particles together. The porous metal has interconnected porosity, i.e., pores that are connected together and to the surfaces of the lower plate 154 to allow steam to flow from one side to the other. The pores have a diameter in a range from about 0.2 microns to about 100 microns. The metal powder that is used to form the porous metal may be stainless steel, titanium, nickel, nickel alloys, or bronze. Stainless steel has been found particularly suitable. The lower plate 154 may be secured to the upper plate 152 by welding or by mechanical means. When the steam distribution plate 150 is used in the diffuser assembly 14 in lieu of the bottom wall 92, process steam in each zone 104 will first pass through the slots 156 and then flow through the porous metal of the lower plate 154 aligned under the slots 156. The porous metal uniformly distributes the process steam onto the moving web W.

Another modification that can be made to the first steam shower 10 is the diffuser assembly 14 may have a multi-piece construction instead of a unitary one-piece construction. In one multi-piece embodiment, the diffuser assembly 14 has a plurality of sections (such as two, three, four etc.) that are releasably secured together end-to-end. In this embodiment, each section has at least one connecting end plate that is releasably secured (such as by bolts) to a connecting end plate of an adjacent section. In each section, each zone 104 adjacent to a connecting end plate is formed by one baffle plate 100 and the connecting end plate, i.e., the connecting end plate replaces one of the pair of baffle plates 100 that would otherwise help form the zone 104.

With a multi-piece construction as described above, the diffuser assembly 14 may be pulled out and disassembled in sections on the tending side of the paper machine. More specifically, a first section of the diffuser assembly 14 may be moved outside the cross-beam 12 (through the enlarged opening in the end plate 30) just enough to provide access to its single connecting end plate so that the first section can be disconnected (such as by removing the bolts) from a first connecting end plate of an adjacent second section and removed from the remainder of the diffuser assembly 14. The second section is then moved outside the cross-beam 12 (through the enlarged opening in the end plate 30) just enough to provide access to its opposing second connecting end plate so that the second section can be disconnected (such as by removing the bolts) from an adjacent third section and removed from the remainder of the diffuser assembly 14. This procedure is repeated until the entire diffuser assembly 14 has been disassembled and entirely removed from the cross-beam 12. The diffuser assembly 14 is reinstalled in the cross-beam 12 by inserting and reassembling the diffuser assembly 14 section by section, in a similar, but opposite manner as the diffuser assembly 14 is removed. As can be appreciated, such a multi-piece construction is quite useful for those installations where there is limited space on the tending side of the paper machine.

In another multi-piece embodiment, the diffuser assembly 14 has a two-piece construction, the passage 68 has two open ends, one extending through the end plate 30 and the other extending through the end plate 32. In addition, each of the end plates 96, 98 has a handle 102 mounted thereto. With a two-piece construction, the diffuser assembly 14 has a first section that includes the end plate 96 and contains half of the zones 104 and a second section that includes the end plate 98 and contains the other half of the zones 104. Each of the first and second sections is movable between a retracted position, wherein the section is fully disposed inside the passage 68 within the cross-beam 12, and an extended position, wherein the section is disposed outside the passage 68 and the cross-beam 12. When moving from their retracted positions to their extended positions, the first and second sections move in opposing directions, respectively, with the first section moving longitudinally outward through the end plate 30 on the tending end and the second section moving longitudinally outward through the end plate 32 on the driving end. Thus, when the first and second sections are in their extended positions, the first and second sections extend longitudinally outward from opposing ends of the cross-beam 12. When the first and second sections are in their retracted position, inner ends of the first and second sections abut each other inside the passage 68.

Figure 8:
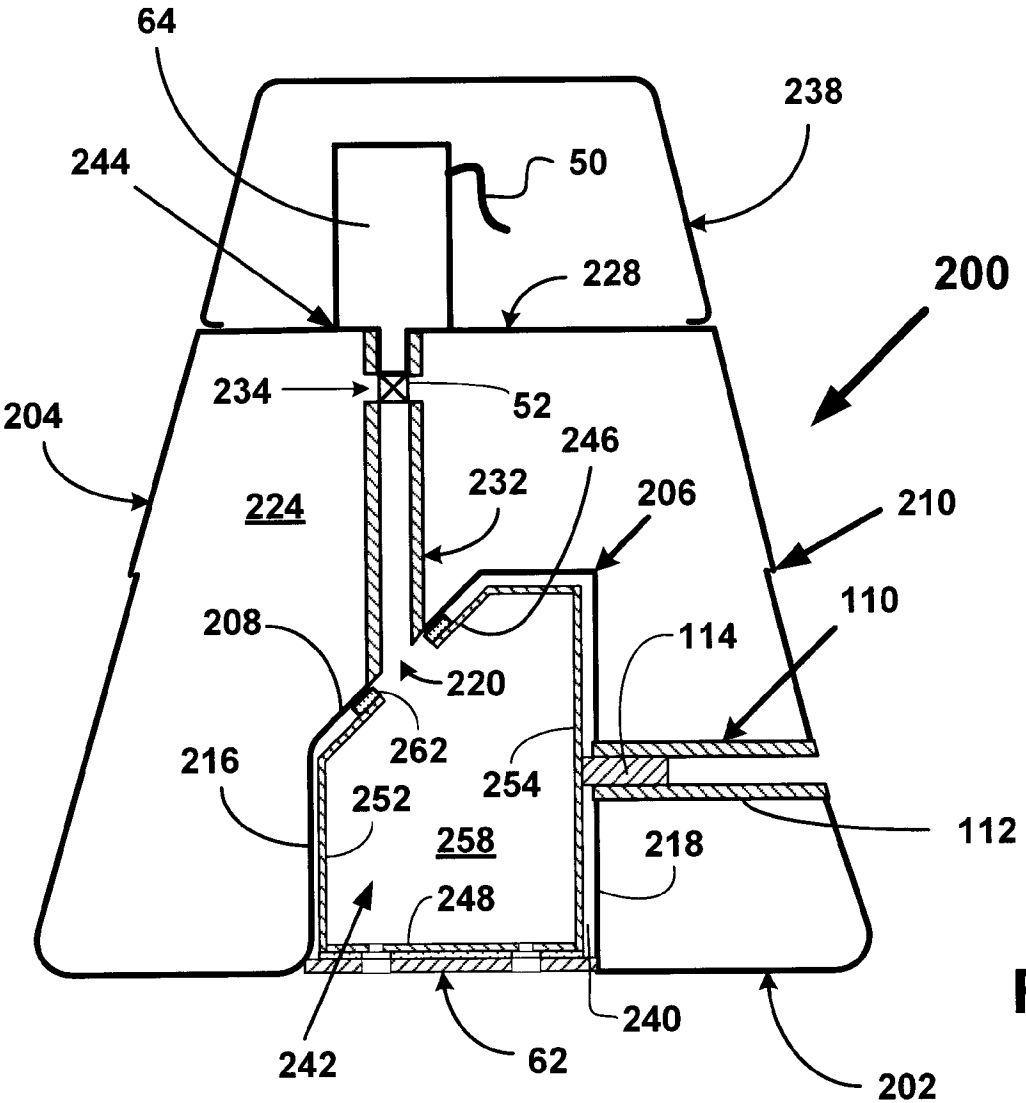
FIG. 8 shows a side sectional view of a second steam shower having a diffuser assembly movably mounted to a cross-beam.
Figure 9:
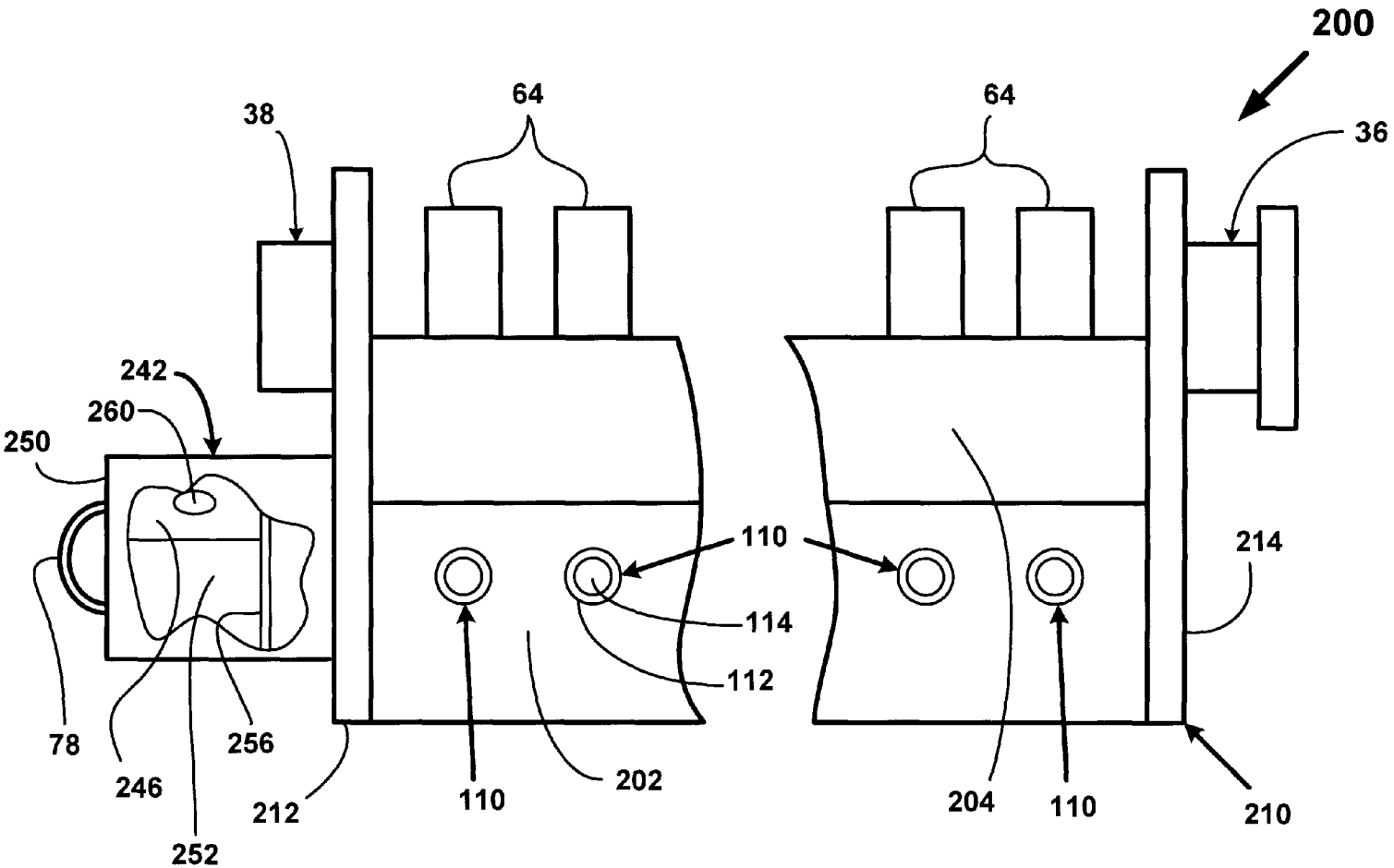
FIG. 9 shows a broken rear view of the second steam shower with the diffuser assembly partially moved outward from the cross-beam, with a portion of the rear wall of the diffuser assembly cut away and with a cover of the cross-beam removed.

Referring now to FIGS. 8 and 9, a second steam shower 200 constructed in accordance with a second embodiment of the present invention is shown. The second steam shower 200 and the first steam shower 10 have a number of components that are identical and, thus, will share the same reference numerals, as generally noted at the beginning of the description section. For purposes of brevity, such identical components will not be described again with regard to the second steam shower 200.

The second steam shower 200 includes a crossbeam 210 that comprises a base structure 202, a shroud 204 and end plates 212 and 214 and a cover 238, each of which is formed from a metal, such as steel. The shroud 204 is secured to the base structure 202, such as by welding. The end plate 212 is secured (such as by welding) to the ends of base structure 202 and the shroud 204 on the tending side, while the end plate 214 is secured (such as by welding) to the ends of the base structure 202 and the shroud 204 on the driving side. The base structure 202, the shroud 204 and the end plates 212, 214 cooperate to define an internal steam chamber or header 224 within the cross-beam 210.

At the driving end of the cross-beam 210, one end of the steam inlet pipe 36 is secured to the end plate 214 around an opening in the end plate 214. The other end of the steam inlet pipe 36 is connected to a process steam source (not shown). Steam from the process steam source is provided to the steam header 224 through the steam inlet pipe 36 and the opening in the end plate 214. At the tending end of the cross-beam 210, the pipe 38 with the closed end is secured to the end plate 212. The pipes 36, 38 may be connected to brackets (not shown), which support the second steam shower 200 against the frames of the paper machine. Pneumatic cylinders may be used with the bracket to move the second steam shower 200.

The base structure 202 includes a recessed portion 206 that is defined by a sloping wall 208, a horizontal top wall, a vertical front wall 216 and a vertical rear wall 218. An array of orifices 220 is formed in the sloping wall 208.

An array of orifices is formed in a top wall 228 of the shroud 204. The orifices in the top wall 228 are vertically aligned with the orifices 220, respectively, so as to form pairs of aligned orifices. In each such pair of orifices, a pipe 232 connects the orifices, with a beveled bottom end of the pipe 232 being secured (such as by welding) to the sloping wall 208 around the orifice 220 and a top end of the pipe 232 being secured (such as by welding) to the top wall 228 around the orifice therein. A pair of orifices 234 is formed in each pipe 232 in a portion of the pipe 232 located in the steam header 224. A valve 52 is disposed in each pipe 232 and is movable by an actuator 64 to open and close the orifices 234. Each actuator 64 has a lower portion disposed in the pipe 232 associated with the actuator 64 and an upper portion that extends vertically upwardly from the top wall 228. Each actuator 64 receives a control signal from the control system over a communication line 50 and in response thereto controls the amount of opening of the valve 52 associated with the actuator 64. As will be described more fully below, each pipe 232 and its associated valve 52 and actuator 64 form a valve module 244 that connects the steam header 224 to an associated zone 252 in a diffuser assembly 242.

The cover 238 may be provided to cover the top portions of the actuators 64 and the communication lines 50. The cover 238 may be movably or removably mounted to the top wall 228 to provide access to the actuators 64 and the communication lines 50. For example, a longitudinal first edge of the cover 238 may be connected by a hinge to the top wall 228 and an opposing longitudinal second edge of the cover 238 may be provided with a clip that engages a structure on the top wall 228 to releasably hold the second edge of the cover 238 against the top wall 228. With this construction, the cover 238 may be pivoted along the hinge between an open position, wherein the actuators 64 and the communication lines 50 are exposed and are accessible, and a closed position, wherein the cover 238 encloses the top portions of the actuators 64 and the communication lines 50 and are inaccessible.

The face plate 62 is secured between the front wall 216 and the rear wall 218, such as by spot welding. The face plate 62 cooperates with the recessed portion 206 to define a passage 240 within the cross-beam 210 that extends substantially the entire length of the cross-beam 210. The passage 240 is disposed substantially in the center of the cross-beam 210 and divides the steam header 224 into front and rear portions. The end plate 212 has an enlarged opening that corresponds to, and is aligned with, the recessed portion 206 of the base structure 202. This enlarged opening provides the passage 240 with an open end that extends through the end plate 212. The end plate 214 may, similarly, have an enlarged opening that corresponds to, and is aligned with, the recessed portion 206 in order to provide the passage 240 with a second, opposing open end that extends through the end plate 214. Alternately, the end plate 214 may cover the entire open end of the structure formed by the cover 238, the shroud 204 and the base structure 202, including the end of the recessed portion 206. With the end plate 214 so constructed, the passage 240 will have a closed end formed by the end plate 214 and an open end extending through the end plate 212.

The diffuser assembly 242 is telescopically mounted to the cross-beam 210 so as to be movable through the passage 240 between a retracted position, wherein the entire diffuser assembly 242 is fully disposed inside the passage 240 within the cross-beam 210, and an extended position, wherein all or most of the diffuser assembly 242 is disposed outside the passage 240 and the cross-beam 210. Of course, the entire diffuser assembly 242 may be completely removed from the cross-beam 210 through the enlarged opening in the end plate 212 and moved away from the paper machine. If the passage 240 has two open ends, the diffuser assembly 242 may extend longitudinally outward from either the tending end or the driving end of the cross-beam 210 when the diffuser assembly 242 is in the extended position, depending on which direction the diffuser assembly 242 is moved. If the passage 240 has only one open end (through the end plate 212), the diffuser assembly 242 extends longitudinally outward from the tending end of the cross-beam 210 when the diffuser assembly 242 is in the extended position. The passage 240 is sized to permit the diffuser assembly 242 to facilely slide within the passage 240. More specifically, the passage 240 is sized such that when the diffuser assembly 242 is in the retracted position, gaps are formed between the diffuser assembly 242 and the recessed portion 206.

The diffuser assembly 242 has a shape that corresponds to the shape of the passage 240 and includes a sloping wall 246, a top wall, a bottom wall 248, an end plate 250 and an opposing end plate, a front wall 252, a rear wall 254 and a plurality of baffle plates 256 (shown in FIG. 9), all of which are composed of metal, such as steel. Handles 78 may be secured to the end plate 250 and the opposing end plate, respectively. The baffle plates 256 are evenly spaced apart and divide the interior of the diffuser assembly 242 into a series of compartments or zones 258. A series of inlet openings 260 are formed in the sloping wall 246 such that each zone 258 has an inlet opening 260. When the diffuser assembly 242 is in the retracted position within the cross-beam 210, the inlet opening 260 in each zone 258 is aligned with the orifice 220 in the sloping wall 246 for the valve module 244 corresponding to the zone 258. When the diffuser assembly 242 is in the extended position, all of the zones 258 are disposed outside of the cross-beam 210. A gasket 262 with openings is secured to the exterior of the sloping wall 246 such that the openings are aligned over the inlet openings 260. The gasket 262 may be secured to the sloping wall 246 by adhesive and/or by mechanical means. The gasket 262 is composed of a compressible material, such as rubber, silicone, or a polymer such as polytetrafluoroethylene or polychlorotrifluoroethylene. In lieu of using a single gasket 262, a plurality of gaskets may be used, one for each of the orifices 220.

The bottom wall 248 may have the same construction as the bottom wall 92 of the diffuser assembly 14 of the first first steam shower 10, or may have the construction of the steam distribution plate 150 described above with regard to the first steam shower 10.

As with the diffuser assembly 14 in the first steam shower 10, the diffuser assembly 242 may have a multi-piece construction. In addition, the diffuser assembly 242 may also be provided with wheels or pads composed a low friction material to facilitate the movement of the diffuser assembly 242 within the passage 240.

The steam shower 200 is provided with the locking devices 110 to secure the diffuser assembly 242 in the retracted position and to form sealed connections between the inlet openings 260 and the orifices 220. When the locking devices 110 are activated, the pistons 114 contact the rear wall 254 of the diffuser assembly 242 and move the diffuser assembly 242 forward so that the gasket 262 contacts the sloping wall 208 of the base structure 202. The pistons 114 press the gasket 262 against the sloping wall 208, thereby securing the diffuser assembly 242 from movement and forming seals between the orifices 220 and the inlet openings 260 to prevent steam leakage.

The operation of the second steam shower 200 will now be described with reference to FIGS. 8 and 9. Pressurized process steam enters the steam inlet pipe 36 and flows into the steam header 224. For each valve module 244 having an open valve 52, steam flows into the pipe 232 through the orifices 234 travels through the pipe 232, exits the pipe 232 through the orifice 220 in the sloping wall 208 and enters the zone 258 corresponding to the valve module 244 through the inlet opening 260 in the diffuser assembly 242. After entering the zone 258, the steam travels to the bottom wall 248, passes through the orifices in the bottom wall 248 and then exits the steam shower 200 through the slots 74-80 in the face plate 62. After exiting the steam shower 200, the steam impinges on the surface of the moving web W.

The second steam shower 200 operates in substantially the same manner and provides substantially the same benefits as the first steam shower 10. The second steam shower 200, however, provides the added benefit of having portions of the steam header 224 located at the bottom, front and rear of the cross-beam 210. In this manner, most of the exterior surfaces of the cross-beam 210 are heated, which discourages condensation from forming on most of the exterior surfaces and dripping onto the web W.

Figure 10:
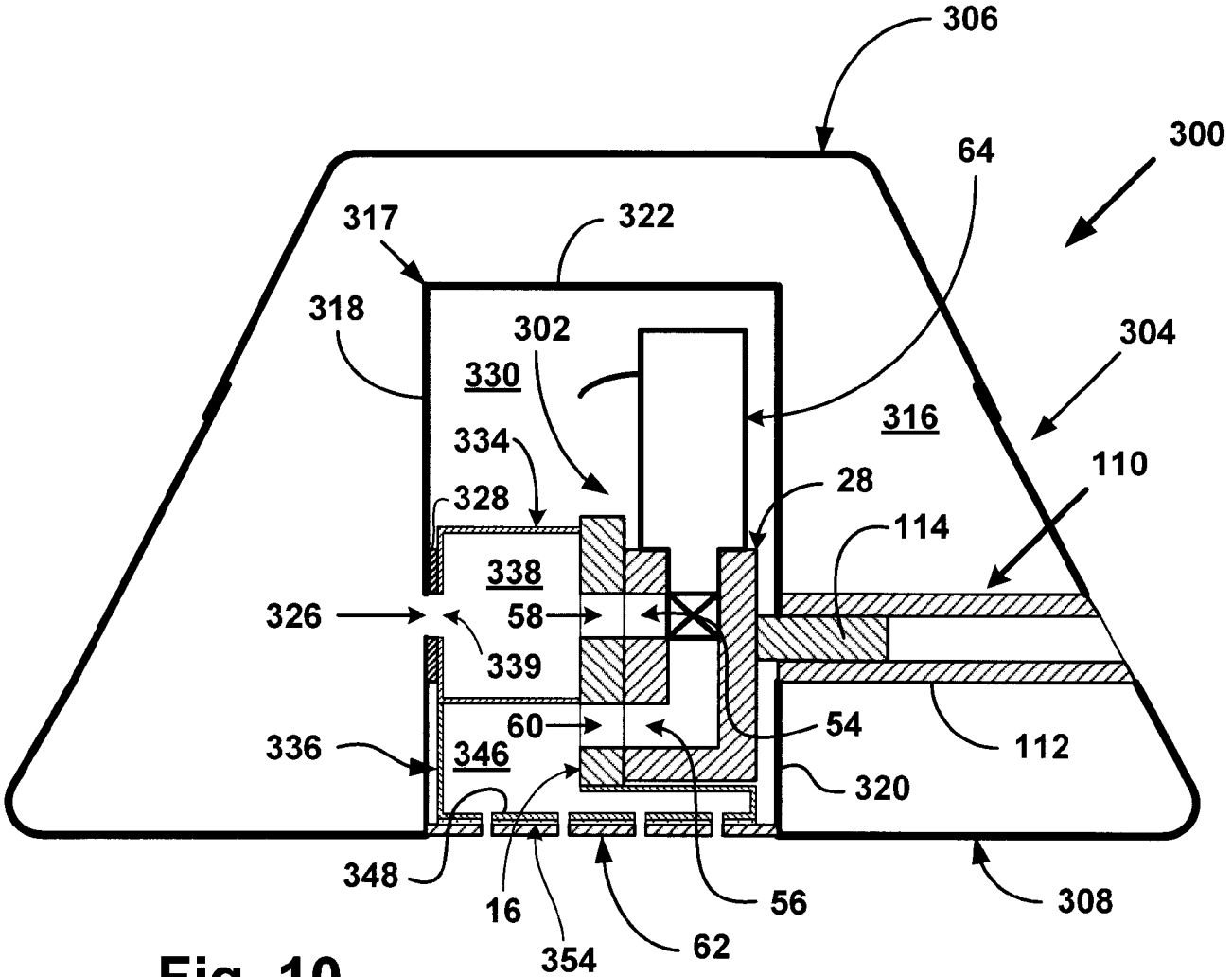
FIG. 10 shows a side sectional view of a third steam shower having a steam provision assembly movably mounted to a cross-beam.
Figure 11:
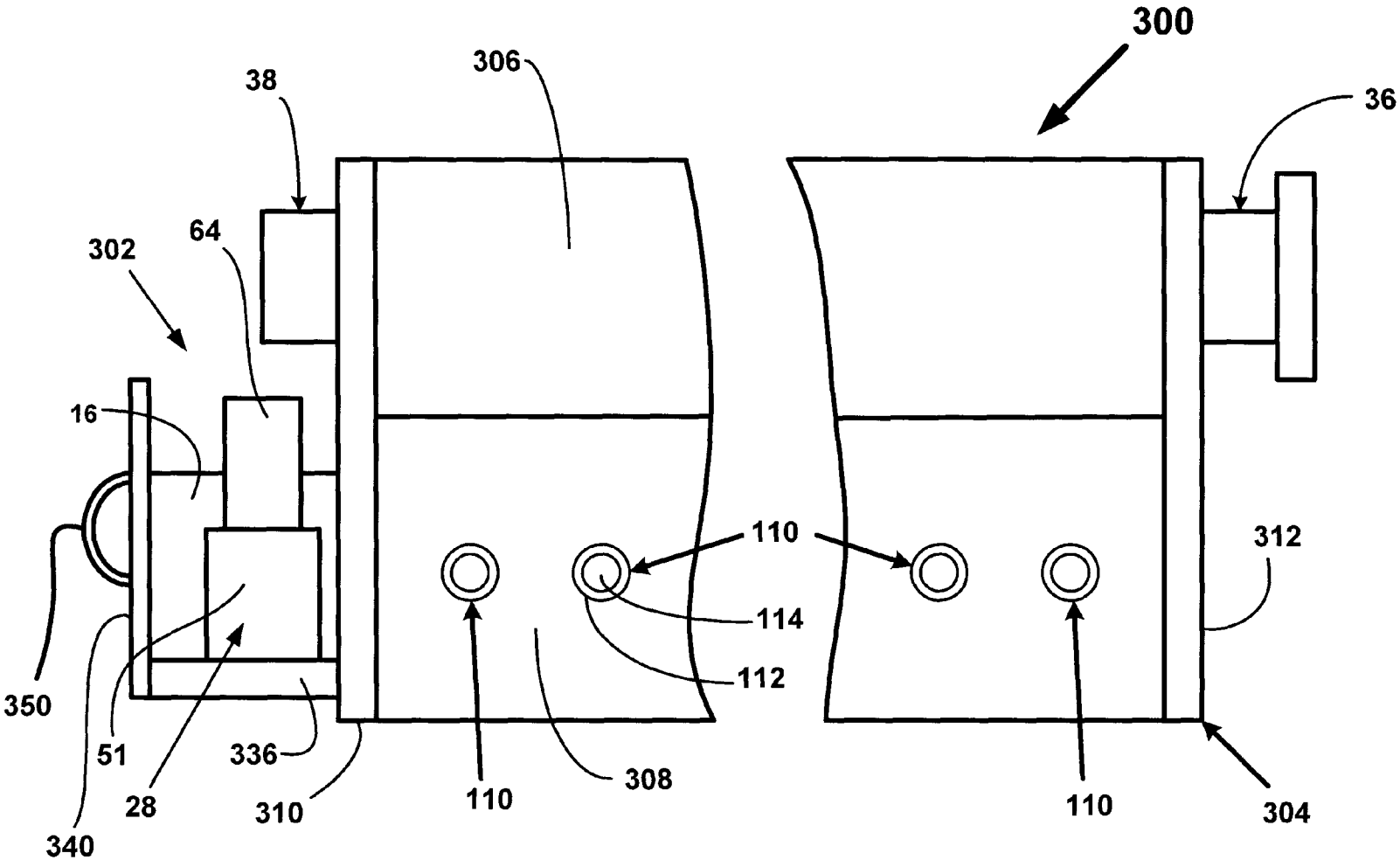
FIG. 11 shows a broken rear view of the third steam shower with the steam provision assembly partially moved outward from the cross-beam.
Figure 12:
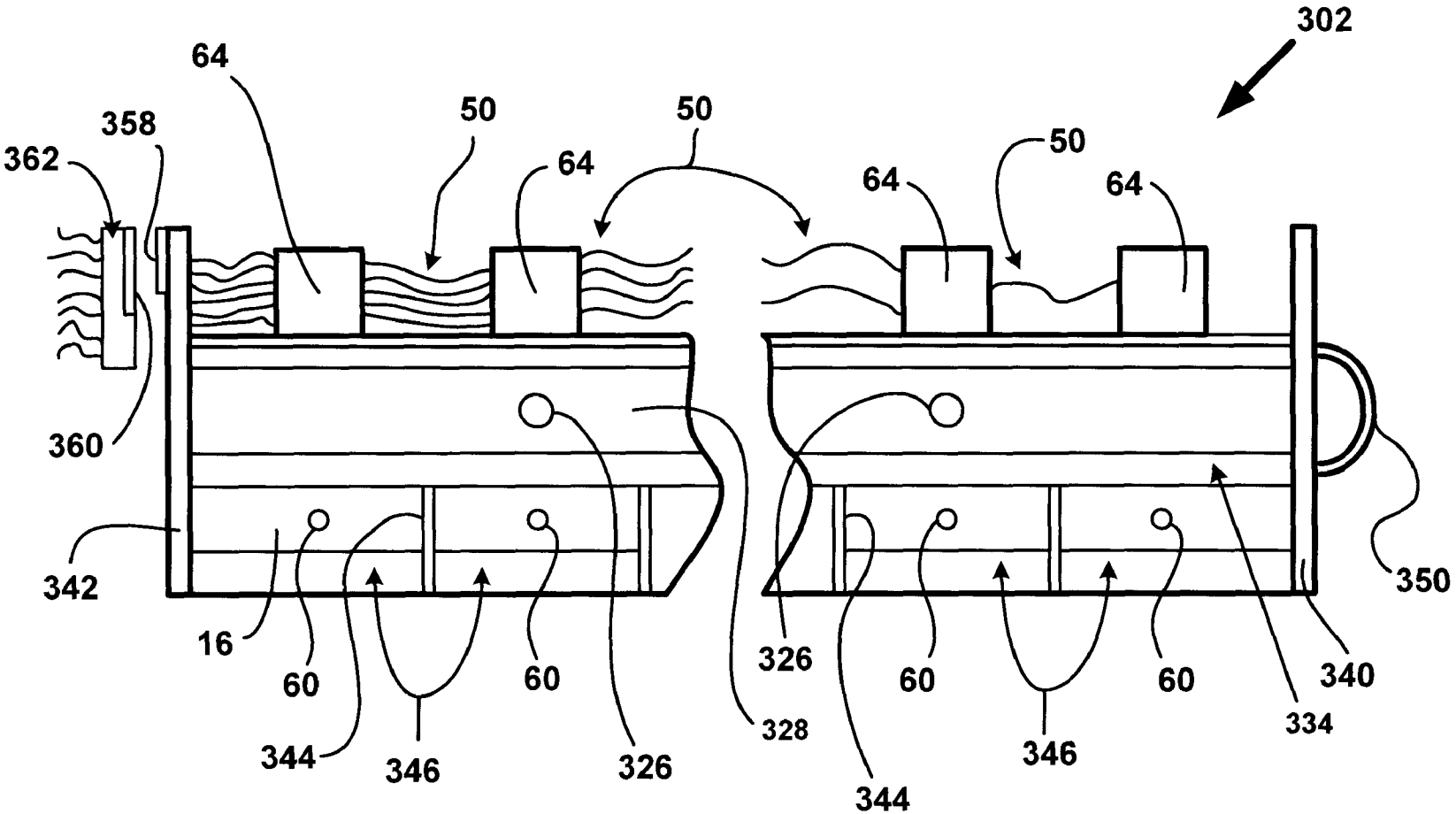
FIG. 12 shows a broken front view of the steam provision assembly with a front portion of a conduit removed to show steam zones of a diffuser assembly of the steam provision assembly.

Referring now to FIGS. 10-12, there is shown a third steam shower 300 constructed in accordance with a third embodiment of the present invention. The third steam shower 300 and the first steam shower 10 have a number of components that are identical and, thus, will share the same reference numerals, as generally noted at the beginning of the description section. For purposes of brevity, such identical components will not be described again with regard to the third steam shower 300. The third steam shower 300 generally includes a steam provision assembly 302 movably mounted to a cross-beam 304.

The cross-beam 304 includes a top section 306, a bottom section 308, and end plates 310, 312, each of which is composed of a metal, such as steel. The top and bottom sections 306, 308 are secured together, such as by longitudinal welds, and the end plates 310, 312 are secured to opposing ends of the thusly formed structure, respectively, such as by welding. When secured together in this manner, the top and bottom sections 306, 308 and the end plates 310, 312 cooperate to define an internal primary steam chamber or header 316 within the cross-beam 304.

At the driving end of the cross-beam 304, one end of the steam inlet pipe 36 is secured to the end plate 312 around an opening in the end plate 312. The other end of the steam inlet pipe 36 is connected to a process steam source (not shown). Steam from the process steam source is provided to the primary steam header 316 through the steam inlet pipe 36 and the opening in the end plate 312. At the tending end of the cross-beam 304, the pipe 38 with the closed end is secured to the end plate 310. The pipes 36, 38 may be connected to brackets (not shown), which support the third steam shower 300 against the frames of the paper machine. Pneumatic cylinders may be used with the bracket to move the third steam shower 300.

The bottom section 308 includes a recessed portion 317 that is defined by interior front and rear walls 318, 320 and an interior top wall 322. One or more orifices 326 are formed in the interior front wall 318. The one or more orifices 326 may be located toward the longitudinal center of the cross-beam 304, toward the ends of the cross-beam 304, respectively, or evenly spaced along the length of the cross-beam 304. In the embodiment shown in FIG. 12, two orifices 326 are formed in the interior front wall 318, toward the ends of the cross-beam, respectively.

The face plate 62 is secured between the interior front and rear walls 318, 320, such as by spot welding. The face plate 62 cooperates with the recessed portion 317 to define a passage 330 within the cross-beam 304 that extends substantially the entire length of the cross-beam 304. The passage 330 is disposed substantially in the center of the cross-beam 304 and divides the steam header 316 into front and rear portions. The end plate 312 covers the entire open end of the structure formed by the top and bottom sections 306, 308, including the end of the recessed portion 317. The end plate 310, however, has an enlarged opening that corresponds to the recessed portion 317. In this manner, the passage 330 has a closed end formed by the end plate 312 and an open end that extends through the end plate 310 and through which the steam provision assembly 302 may move.

The steam provision assembly 302 is telescopically mounted to the cross-beam 304 so as to be movable through the passage 330 between a retracted position, wherein the entire steam provision assembly 302 is fully disposed inside the passage 330 within the cross-beam 304, and an extended position, wherein all or most of the steam provision assembly 302 is disposed outside the passage 330 and the cross-beam 304. Of course, the entire steam provision assembly 302 may be completely removed from the cross-beam 304 through the enlarged opening in the end plate 310 and moved away from the paper machine. The passage 330 is sized to permit the steam provision assembly 302 to facilely slide within the passage 330. More specifically, the passage 330 is sized such that when the steam provision assembly 302 is in the retracted position, gaps are formed between the steam provision assembly 302 and the recessed portion 317. When the steam provision assembly 302 is in the extended position, the steam provision assembly 302 extends longitudinally outward from the tending end of the cross-beam 304.

The steam provision assembly 302 generally includes a steam conduit 334, the mounting plate 16, a diffuser assembly 336, end plates 340, 342 and a plurality of the valve modules 28. The steam conduit 334, the diffuser assembly 336 and the end plates 340, 342 are each composed of metal, such as steel.

The steam conduit 334 is secured (such as by welding) along its length to the mounting plate 16, and at its ends to the end plates 340, 342, respectively. Together, the steam conduit 334, the mounting plate 16 and the end plates 340, 342 cooperate to define a secondary steam chamber or header 338 that extends the length of the steam provision assembly 302. One or more inlet openings 339 are formed in the steam conduit 334 and is/are positioned so as to be aligned with the one or more orifices 326, respectively, in the interior front wall 318 of the bottom section 308 when the steam provision assembly 302 is in the retracted position. The orifices 58 in the mounting plate 16 form outlets of the secondary steam header 338. Each valve module 28 is mounted to the mounting plate 16 (such as by bolts) so that the inlet 54 and the outlet 56 thereof are aligned with a pair of the orifices 58, 60 in the mounting plate 16, respectively. A gasket 328 with one or more openings is secured to the exterior of the steam conduit 334 such that each opening in the gasket 328 is aligned with an inlet opening 339 in the steam conduit 334. The gasket 328 may be secured to the steam conduit 334 by adhesive and/or by mechanical means. The gasket 328 is composed of a compressible material, such as rubber, silicone, or a polymer such as polytetrafluoroethylene or polychloro-trifluoroethylene.

The diffuser assembly 336 is secured (such as by welding) along its length to the mounting plate 16 and to the steam conduit 334, and at its ends to the end plates 340, 342, respectively. Together, the diffuser assembly 336, the mounting plate 16, the steam conduit 334 and the end plats 340, 342 cooperate to define a diffuser chamber that extends the length of the steam provision assembly 302. A plurality of spaced-apart baffle plates 344 are secured within the diffuser chamber so as to divide the diffuser chamber into a series of compartments or zones 346. The orifices 60 of the mounting plate 16 form inlets to the zones 346. The diffuser assembly 336 includes a bottom wall 348 with openings through which steam may exit the zones 346. The bottom wall 348 may have the same construction as the bottom wall 92 of the diffuser assembly 14 of the first first steam shower 10, or may have the construction of the steam distribution plate 150 described above with regard to the first steam shower 10.

The steam shower 300 is provided with a plurality of the locking devices 110 to secure the steam provision assembly 302 in the retracted position and to form sealed connections between the one or more orifices 326 of the cross-beam 304 and the one or more inlet openings 339 of the steam conduit 334. Each pipe 112 is secured to, and extends through, the bottom section 308 of the cross-beam 304, with an outer end of the pipe 112 being secured in an opening in an exterior rear wall of the bottom section 308 and an inner end of the pipe 112 being secured in an opening in the interior rear wall 320 of the bottom section 308, adjacent to a valve body 51. When the locking devices 110 are activated, the pistons 114 contact the valve bodies 51 and move the steam provision assembly 302 forward so that the gasket 328 on the steam conduit 334 comes into contact with the interior front wall 318. The pistons 114 press the gasket 328 against the interior front wall 318, thereby securing the steam provision assembly 302 from movement and forming seals between the one or more inlet openings 339 in the steam conduit 334 and the one or more orifices 326 in the interior front wall 318 of the cross-beam 304 to prevent steam leakage.

On the tending end of the steam shower 300, the end plate 340 of the steam provision assembly 302 is provided with a handle 350 which may be grasped by maintenance personnel to push and/or pull the steam provision assembly 302 between the extended and retracted positions. In order to facilitate the movement of the steam provision assembly 302, the steam provision assembly 302 may be provided with pads 354 composed of a low friction material, such as PTFE, FEP, a PFA polymer, or brass. The pads 354 may be secured to those surfaces of the steam provision assembly 302 that experience significant friction during movement. For example, the pads 354 may be secured to the bottom surface of the bottom wall 348 of the diffuser assembly 336. In lieu of the pads 354, the steam provision assembly 302 may be provided with wheels (not shown) that are supported on non-perforated portions of the face plate 62 located toward the longitudinal edges thereof, or on tracks mounted to the interior front and rear walls 318, 320, respectively.

On the driving end of the steam shower 300, the end plate 342 of the steam provision assembly 302 is provided with one or more quick disconnect (QD) couplers 358 that extend from, or are otherwise accessible from, an exterior surface of the end plate 342. The one or more QD couplers 358 are connected to provide control signals (electronic or pneumatic) to the actuators 64 of the valve modules 28. The one or more QD couplers 358 are aligned with and adapted to mate with one or more corresponding QD couplers 360 that may extend from, or are otherwise accessible from, an inner surface of the end plate 312 of the cross-beam 304. The one or more QD couplers 360 are connected to the control system by electrical or pneumatic lines. When the steam provision assembly 302 is in the retracted position, the one or more QD couplers 358 mate with the one or more QD couplers 360 to provide control signals from the control system to the flow regulating devices (e.g., the actuators 64) of the steam provision assembly 302. When the steam provision assembly 302 is moved away from the retracted position, the one or more QD couplers 358 disconnect from the one or more QD couplers 360, thereby cutting off control signals to the flow regulating devices (e.g., the actuators 64) of the steam provision assembly 302.

In lieu of having the one or more QD couplers 360 mounted to the inner surface of the end plate 312, the one or more QD couplers 360 may be mounted to a connection plate 362 that can be removably fastened to the end plate 342 of the steam provision assembly 302 by bolts or other fastening means, as shown in FIG. 12 In this embodiment, the end plate 312 of the cross-beam 304 does not cover the end of the recessed portion 317 and, thus, the passage 330 has two open ends, one extending through the end plate 310 and one extending through the end plate 312. With two open ends, a second handle 350 may be fixed to the end plate 342 if there is enough room to move the steam provision assembly 302 outward on the driving side of the paper machine. When the connection plate 362 is mounted to the end plate 342, the connection plate 362 is disposed in the opening in the end plate 312 that is aligned with the recessed portion 317. Before the steam provision assembly 302 can be moved to the extended position, the connection plate 362 must be unfastened from the end plate 342 and the QD couplers 360 disconnected from the QD couplers 358.

In a manner similar to the diffuser assembly 14 in the first steam shower 10, the steam provision assembly 302 may have a multi-piece construction instead of a unitary one-piece construction. In one multi-piece embodiment, the steam provision assembly 302 has a plurality of sections (such as two, three, four etc.) that are secured together end-to-end. In this embodiment, each section has at least one connecting end plate that is releasably secured (such as by bolts) to a connecting end plate of an adjacent section. Each connecting end plate is provided with one or more internal QD couplers that are adapted to mate with the one or more internal QD couplers of a connecting end plate of an adjacent section in order to provide a separable control signal pathway across the steam provision assembly 302. In a manner similar to that described above with regard to the diffuser assembly 14, the steam provision assembly 302 may (on the tending side of the paper machine) be pulled out and disassembled in sections and then, after any cleaning or maintenance, be pushed in and reassembled in sections.

In another multi-piece embodiment, the steam provision assembly 302 has a two-piece construction, wherein the one or more QD couplers 360 are mounted to the connection plate 362 and the passage 330 has two open ends, one extending through the end plate 310 and one extending through the end plate 312. The connection plate 362 is movable away from the open end of the passage 330 through the end plate 312. With a two-piece construction, the steam provision assembly 302 has a first section that includes the end plate 340 and contains half of the zones 346 and half of the valve modules 28, and a second section that includes the end plate 342 and contains the other half of the zones 346 and the other half of the valve modules 28. An inner end of the first section is provided with one or more internal QD couplers and an inner end of the second section is provided with one or more internal QD couplers that are adapted to mate with the one or more internal QD couplers of the first section.

Each of the first and second sections is movable between a retracted position, wherein the section is fully disposed inside the passage 330 within the cross-beam 304, and an extended position, wherein the section is disposed outside the passage 330 and the cross-beam 304. When moving from their retracted positions to their extended positions, the first and second sections move in opposing directions, respectively, with the first section moving longitudinally outward through the end plate 310 on the tending end and the second section moving longitudinally outward through the end plate 312 on the driving end. Thus, when the first and second sections are in their extended positions, the first and second sections extend longitudinally outward from opposing ends of the cross-beam 304. When the first and second sections are in their retracted positions, the one or more interior QD connectors of the first section mate with the one or more interior QD connectors of the second section to convey control signals between the first and second sections.

In both of the multi-piece embodiments described above, the steam provision assembly 302 does not have a single secondary steam header 338 that extends the length of the steam provision assembly 302. Instead, the steam provision assembly 302 has a plurality of secondary steam headers 338, one for each section of the steam provision assembly 302. For each secondary steam header 338, there is an inlet opening 339 formed in the steam conduit 334 and an orifice 326 formed in the interior front wall 318 of the cross-beam 304, wherein when the steam provision assembly 302 is in the retracted position, the inlet opening 339 and the orifice 326 are aligned to permit steam from the primary steam header 316 to flow into the secondary steam header 338.

The operation of the third steam shower 300 with the steam provision assembly 302 in the retracted position will now be described. Pressurized process steam enters the steam inlet pipe 36 and flows into the primary steam header 316. From the primary steam header 316, the steam flows into the secondary steam header 338 through the aligned one or more inlet openings 339 and the one or more orifices 326. For each valve module 28 having an open valve 52, steam flows through the orifice 58 in the mounting plate 16, passes by the opened valve 52, passes through the orifice 60 in the mounting plate 16 and enters the zone 346 corresponding to the valve module 28. After entering the zone 346, the steam travels to the bottom wall 348, passes through the orifices in the bottom wall 348 and then exits the steam shower 300 through the slots 74-80 in the face plate 62. After exiting the steam shower 300, the steam impinges on the surface of the moving web W.

In order to clean the steam provision assembly 302, the locking devices 110 are first released (deactivated). The steam provision assembly 302 is then manually moved by one or more persons to the extended position, such as by pushing and/or pulling the handle(s) 350. While the steam provision assembly 302 is in the extended position, the diffuser assembly 336 and, more specifically, the zones 346 and the bottom wall 348 may be cleaned using high pressure jets of water, alone or in combination with mechanical means such as brushes. In addition, the valve modules 28 can be readily accessed for maintenance, repair or replacement. Alternately, the diffuser assembly 14 may be completely removed from the cross-beam 12 and moved to another location where the cleaning and maintenance, repair etc. is performed. When the cleaning and any maintenance, repair or replacement of the valve modules 28 is complete, the steam provision assembly 302 is slid back into the cross-beam 304 to the retracted position and the locking devices 110 are activated. As can be appreciated, the cleaning, repair, maintenance, etc. of the third steam shower 300 is much simpler than in prior art steam showers since the entire third steam shower 300 does not need to be removed from the paper machine.

In addition to providing ready access to the valve modules 28 and the diffuser assembly 336, the third steam shower 300 also has a construction that mitigates condensation. With the primary steam header 316 located at the top, bottom, front and rear of the cross-beam 304, all of the exterior surfaces of the cross-beam 304 are heated, which discourages condensation from forming on the exterior surfaces and dripping onto the web W.

The first, second and third steam showers 10, 200, 300 may be mounted in a normal orientation directly above the flat web W such as in a Fourdrinier application, or at an oblique angle orientation, such in a press application.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A steam shower for providing steam to a web in a paper machine, the steam shower comprising:

a cross-beam having a longitudinal axis for disposal in the cross machine direction of the paper machine, the cross-beam having opposing ends and defining an interior steam header for connection to a source of steam; and a diffuser assembly comprising a plurality of separated steam compartments, each steam compartment having an inlet orifice and a plurality of outlet openings through which steam may exit the steam compartment and travel to the web, the diffuser assembly being mounted to the cross-beam for movement in the direction of the longitudinal axis of the cross beam between a retracted position and an extended position, wherein when the diffuser assembly is in the retracted position, the inlet orifices of the steam compartments are connected to the steam header for steam flow from the steam header to the inlet orifices, and wherein when the diffuser assembly is in the extended position, the steam compartments are disposed outward from one of the ends of the cross-beam and the inlet orifices of the steam compartments are disconnected from the steam header.

2. The steam shower of claim 1, further comprising steam valve modules operable to control the flow of steam from the steam header to the inlet orifices of the steam compartments when the diffuser assembly is in the retracted position.

3. The steam shower of claim 2, wherein the cross-beam defines an internal passage through which the diffuser assembly is movable.

4. The steam shower of claim 3, wherein when the diffuser assembly is in the retracted position, the steam compartments are disposed inside the passage.

5. The steam shower of claim 4, wherein the cross-beam comprises a structure that helps define the passage, the structure having openings formed therein;

wherein the diffuser assembly comprises a wall that helps define the steam compartments, the wall having the inlet orifices formed therein;

wherein the openings in the structure are aligned with the inlet orifices in the wall when the diffuser assembly is in the retracted position; and wherein each of the openings in the structure is connected to the steam header by one of the steam valve modules.

6. The steam shower of claim 5, wherein the diffuser assembly is laterally movable in the passage between a disengaged position, wherein the wall of the diffuser assembly is disposed distal to the structure, and an engaged position, wherein the wall is disposed proximate to the structure, and wherein the steam shower further comprises one or more devices operable to move the diffuser assembly from the disengaged position to the engaged position.

7. The steam shower of claim 6, further comprising one or more gaskets secured to one of the wall and the structure so as to be disposed between the wall and the structure when the diffuser assembly is in the retracted position, the one or more gaskets having holes respectively aligned with the openings in the structure and the inlet orifices in the wall when the diffuser assembly is in the retracted position, the gasket being compressed to provide seals between the openings in the structure and the inlet orifices in the wall when the diffuser assembly is in the retracted position and the engaged position.

8. The steam shower of claim 5, wherein the structure of the cross-beam is a mounting plate, the openings in the mounting plate are outlet openings and the mounting plate further comprises inlet openings disposed in the steam header, the inlet openings and the outlet openings being arranged in pairs, with each pair comprising an inlet opening and an outlet opening, and wherein in each pair, the inlet opening is connected to the outlet opening by one of the steam valve modules.

9. The steam shower of claim 2, wherein the diffuser assembly has substantially the same length as the cross-beam.

10. The steam shower of claim 2, wherein the diffuser assembly is a first diffuser assembly and the steam shower comprises a second diffuser assembly having a plurality of steam compartments, the second diffuser assembly being mounted to the cross-beam for movement in the direction of the longitudinal axis of the cross beam between a retracted position and an extended position, wherein the first diffuser assembly and the second diffuser assembly move in opposing directions, whereby when the first and second diffusion assemblies are in the extended positions, the first and second diffusion assemblies extend outward from the opposing ends of the cross-beam, respectively.

11. The steam shower of claim 2, wherein the steam valve modules are mounted to the cross-beam.

12. The steam shower of claim 11, wherein the cross-beam further defines an interior valve chamber that is separated from the steam header, the chamber enclosing at least a portion of each of the steam valve modules.

13. The steam shower of claim 12, wherein the cross-beam comprises a cover that is movable to provide access to the actuators in the valve chamber.

14. The steam shower of claim 13, wherein the valve chamber is located above the steam header.

15. The steam shower of claim 14, wherein when the diffuser assembly is in the retracted position, the diffuser assembly is disposed between front and rear portions of the steam header and below a top portion of the steam header.

16. The steam shower of claim 15, wherein each of the steam valve modules comprises a valve that is mounted in a valve body and is connected to an actuator that is operable to move the valve, and wherein actuators are disposed in the valve chamber and the valves and the valve bodies of the steam valve modules are disposed in the top portion of the steam header.

17. The steam shower of claim 13, wherein the valve chamber is located to the side of the steam header.

18. The steam shower of claim 17, wherein each of the steam valve modules is entirely disposed in the valve chamber.

19. The steam shower of claim 2, further comprising a steam provision assembly that includes the diffuser assembly and the steam valve modules, the steam provision assembly being movable between extended and retracted positions that correspond to the extended and retracted positions of the diffuser assembly, respectively.

20. The steam shower of claim 19, wherein the steam header in the cross beam is a first steam header that extends in the direction of the longitudinal axis of the cross-beam, and wherein the steam provision assembly further comprises a conduit at least partially defining a second steam header that extends in the direction of the longitudinal axis of the cross-beam, the second steam header connecting the inlet orifices of the steam compartments to the first steam header when the diffuser assembly is in the retracted position.

21. The steam shower of claim 20, wherein the cross-beam comprises interior walls defining an internal passage through which the steam provision assembly is movable, a first one of the interior walls of the cross-beam having one or more orifices and the conduit of the steam provision assembly having one or more inlet openings, the one or more orifices in the first one of the walls being aligned with the one or more inlet openings in the conduit when the diffuser assembly is in the retracted position, whereby steam may flow from the first steam header to the second steam header through the aligned one or more orifices and the one or more inlet openings.

22. The steam shower of claim 21, wherein the steam provision assembly is laterally movable in the passage between a disengaged position, wherein the conduit of the steam provision assembly is disposed distal to the first one of the interior walls of the cross-beam, and an engaged position, wherein the conduit is disposed proximate to the first one of the interior walls, and wherein the steam shower further comprises:

one or more devices operable to move the steam provision assembly from the disengaged position to the engaged position; and one or more gaskets secured to one of the conduit and the first one of the interior walls so as to be disposed between the conduit and the first one of the interior walls when the steam provision assembly is in the retracted position, the one or more gaskets having one or more holes respectively aligned with the one or more orifices of the first one of the interior walls and the one or more inlet openings of the conduit when the steam provision assembly is in the retracted position, the gasket being compressed to provide one or more seals between the one or more orifices of the first one of the interior walls and the one or more inlet openings of the conduit when the steam provision assembly is in the retracted position and the engaged position.

23. The steam shower of claim 19, wherein the steam provision assembly comprises a plurality of sections that are releasably secured together end-to-end, each of the sections comprising at least one of the steam compartments and at least one of the steam valve modules.

24. The steam shower of claim 1, wherein the diffuser assembly comprises a bottom wall that includes a plate of porous metal formed from metal powder that is compacted and sintered to provide interconnected porosity.

25. The steam shower of claim 1, wherein the diffuser assembly comprises an end plate having a handle secured thereto.

26. The steam shower of claim 1, wherein the steam compartments are separated by a plurality of baffle plates.

27. The steam shower of claim 1, wherein the diffuser assembly comprises a plurality of sections that are releasably secured together end-to-end, each of the sections comprising at least one of the steam compartments.

* * * * *